United States Patent [19]

Rünzi

[11] Patent Number: 4,548,397

[45] Date of Patent: Oct. 22, 1985

[54] SINGLE-SHEET SEPARATING APPARATUS, PARTICULARLY FOR USE WITH OFFICE MACHINES

[76] Inventor: Kurt Rünzi, Küsnachtstrasse 59, CH-8126 Zumikon, Switzerland

[21] Appl. No.: 559,901

[22] Filed: Dec. 12, 1983

[30] Foreign Application Priority Data

Dec. 16, 1982 [CH] Switzerland ..... 7346/82

[51] Int. Cl.[4] ..... B65H 3/52

[52] U.S. Cl. ..... 271/121; 271/122; 271/125; 271/126

[58] Field of Search ..... 271/116, 122, 125, 126, 271/121

[56] References Cited

U.S. PATENT DOCUMENTS 3,583,696 6/1971 Runzi ..... 271/4
3,754,754 8/1973 Peterson ..... 271/122
3,995,952 12/1976 Schoppe ..... 271/122

*Primary Examiner*—Richard A. Schacher

*Attorney, Agent, or Firm*—Frishauf, Holtz, Goodman & Woodward

[57] ABSTRACT

To separate sheets from a stack, for example being fed upwardly, two separating stages are provided: one separating stage is formed by a driven third feed roller (28) located immediately above a fixed separating element (30), for example a rubber block. If, by chance, two sheets should be fed, the sheets are then fed to a second separating stage which includes a driven second roller (16) which, for example, may drive the third roller, and a first roller (20) therebeneath which can freely rotate in feeding direction. It is secured to a shaft by a one-way clutch, preventing reverse rotation. To impart limited reverse rotation to the first roller (20), the shaft thereof is rocked backwardly by an eccenter (50, 52) coupled to the shaft (18) which drives the entire apparatus. To feed sheets from a stack, the stack is height-adjustable by sensing deflection of the third roller (28) upon engagement with the topmost sheet of the stack, and controlling switching of an electric elevator motor, raising the stack, in accordance with sensed deflection.

16 Claims, 5 Drawing Figures

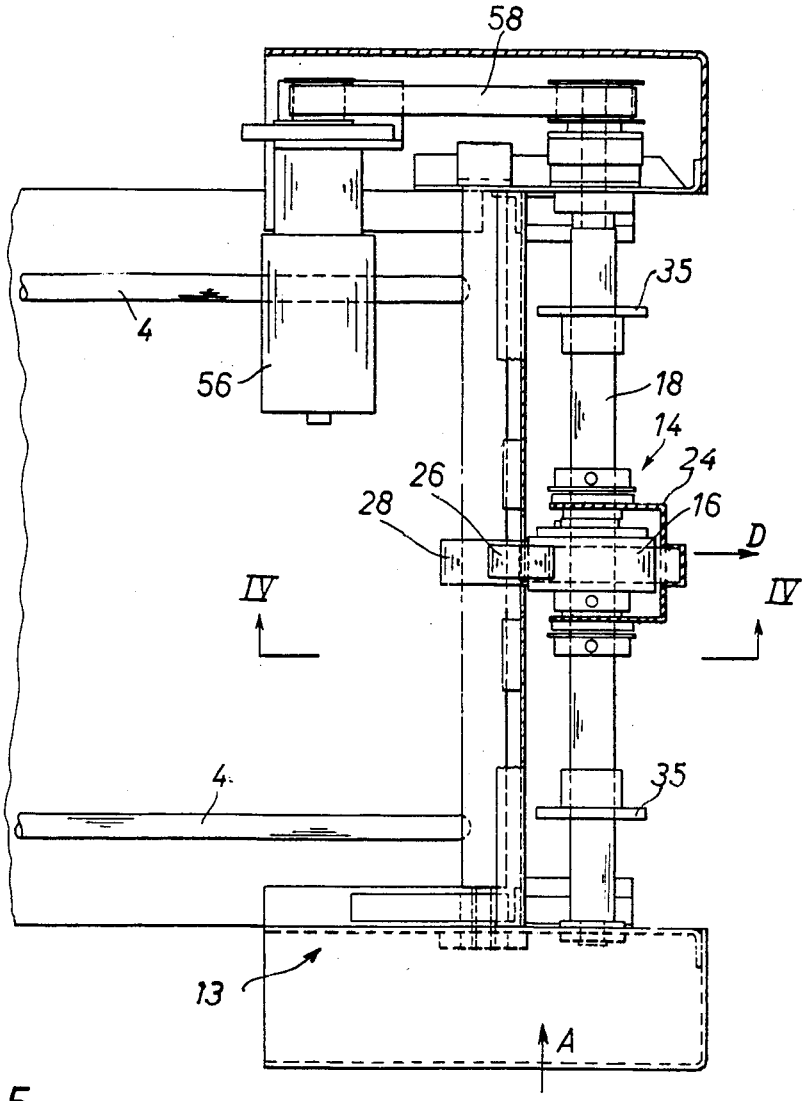
Fig. 2
Fig.5
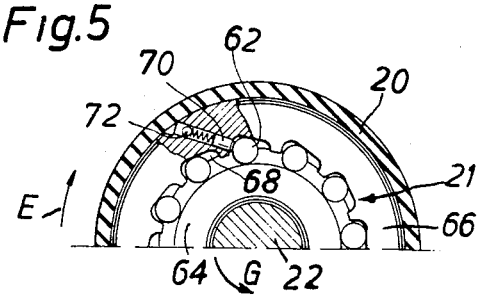

SINGLE-SHEET SEPARATING APPARATUS, PARTICULARLY FOR USE WITH OFFICE MACHINES

Reference to related patent and applications, the disclosure of which is hereby incorporated by reference:

U.S. Pat. No. 3,583,696, Runzi. U.S. Applications: U.S. Ser. No. 536,862, filed Sept. 29, 1983. "Single Sheet Feeding Apparatus for Office-Type Automatic Writing Machines"; U.S. Ser. No. 536,863, filed Sept. 29, 1983, "Single-Sheet Supply Apparatus for Typewriters, Automatic Printers, and the like, and Sheet-Feeding Method"; both by the inventor hereof.

The present invention relates to sheet feeding apparatus, and more particularly to apparatus to separate sheets which are being fed to an office machine, for example a typewriter, a copy machine, a word processor printer, or the like.

BACKGROUND

It is frequently difficult to prevent misfeeds in office machinery and the like, where sheets must be separated, individually, from a stack. Sheet separation is necessary to prevent malfunction of the equipment using single sheets. Separation of stacked sheets is a continuous problem since the respective superimposed sheets have a tendency to adhere. This adhesion is due to many factors, such as excessive ambient humidity, lack of ambient humidity, and hence static electricity due to friction between the sheets, overlap at cut edges, or the like.

THE INVENTION

It is an object to provide a sheet separating apparatus which operates reliably and is simple in construction so that it can be readily adapted for combination with office-type machines, which is suitable for operation with paper of different thicknesses and which provides for single-sheet feeding which is gentle and handles the paper without damage thereto.

Briefly, the sheet is fed in a nip between two rollers; one of these rollers is driven in feeding direction until the sheet is gripped in the nip by further transport rollers. A roller is secured to a shaft by a one-way clutch which permits overrunning of the roller even though feeding drive to the roller, e.g. through another roller, has stopped. To prevent multiple feeding, the shaft itself is, after the initial feeding movement, subjected to reverse rotation, for example by a rocker, thereby rocking the shaft about a limited rotary angle and moving the roller —now moving with the shaft—in reverse direction to thereby separate the sheet being fed from an adjacent sheet.

The apparatus has the advantage that it can be constructed simply and inexpensively. By providing a counter-rotating movement to the roller—which need not necessarily even be the feed roller—double feed is reliably prevented. The movement simulates that which is carried out by hand when superposed sheets are separated by rubbing movement, in opposite direction, between thumb and forefinger, for example. The arrangement in which a roller feeds in one direction, and the same or another roller operates in a different direction for a limited extent only, by virtue of moving its shaft for a limited extent, while permitting free rotation of the roller in feeding direction, makes it possible to so arrange rollers at opposite surfaces on the paper that the feed or engagement pressure on the sheet is low. Such low engagement pressure simplifies gripping of a single sheet in a feeding nip and prevents damage to the sheet, or crinkling or creasing thereof.

In accordance with a feature of the invention, movement of the roller in opposite direction, by moving the shaft in opposite direction, is derived from an eccenter element, preferably positioned on the roller which is to be moved in counter-feeding direction. This arrangement permits particularly compact construction, avoids the necessity for a separate second drive source operating in different direction, and is eminently suitable for equipment where space is at a premium, while requiring the utmost in reliability—typical for office-type machinery.

In accordance with a feature of the invention, a pivotably located additional or third roller can be provided which senses the pull-off of the sheet and controls a height-adjustment stacking motor, to permit pull-off of a number of sheets, sequentially, from the stack before the stack itself is re-positioned at a certain level with respect to the feed rollers.

In accordance with a preferred feature of the invention, the stack is located on a platform, guided in vertical guide rails, and adjusted, in height, by a motor drive which includes a gear or sprocket belt. Such an arrangement permits stacking of numerous sheets, for example several reams which may have a high stacking weight. Replenishing of paper supply, thus, can be left to long intervals, which improves office operation efficiency. Stacks which accept several reams of paper require motor-drive height adjustment, however, since spring force, alone, used with tiltable cassettes and the like, must be so constructed that the spring force which presses the uppermost sheet towards a pull-off or feed roller need not be considered when adjusting the position of the sheets by a motor.

DRAWINGS

FIG. 2 is a top view of the device of FIG. 1;

FIG. 5 is a fractional schematic cross-sectional view through a one-way clutch for a roller, as used in the present application.

DETAILED DESCRIPTION

Figure 1:
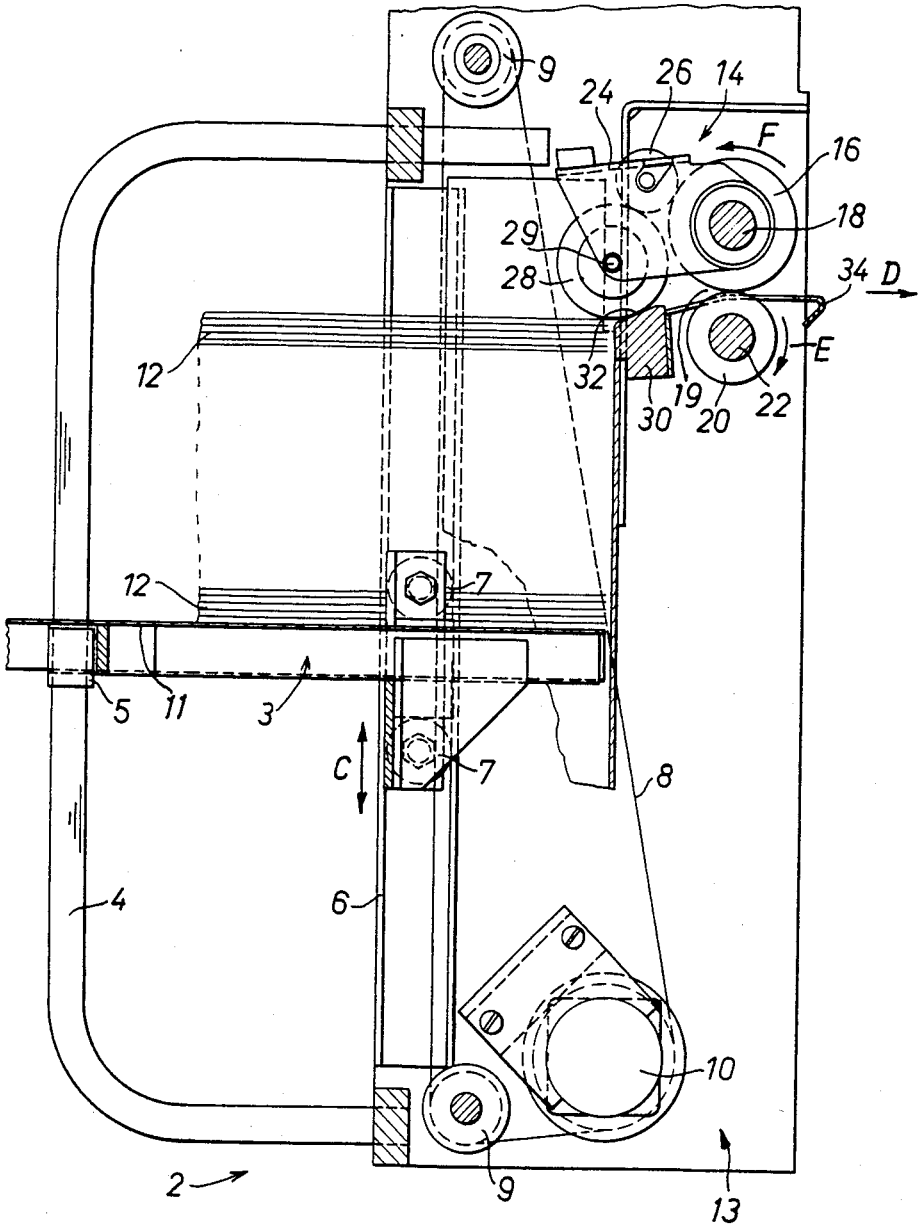
FIG. 1 is a schematic vertical section through the paper feed device, together with an elevator for a stack of sheets, omitting all parts not necessary for an understanding of the invention.

The invention will be described in connection with a sheet feeding device suitable for an office-type machine, for example a copy machine, or an output printer for a word processor. A stack of sheets 12 (FIG. 1) is provided, located on a platform 11 of an elevator structure 3. The purpose of the apparatus is to feed the uppermost sheet from the stack 12.

The platform 11 can be located at any suitable height, to receive a stack 12 of cut sheets, for example of standard letter format, and capable of retaining, for example, several reams of such paper thereon. The platform 11 is vertically positioned by a pair of rollers 7, guided in a suitable guide rails 6. The vertical position of the elevator 3 formed by the platform 11 guided in the rails 6 is effected by two endless gear or sprocket belts 8, commonly driven by a drive motor 10. The gear or sprocket belts 8 are guided over upper and lower rollers 9. A pair of guide sleeves 5, surrounding tubular frame elements 4 and positioned at the left side of the platform 11 insure horizontal guidance thereof. The elevator 3, and specifically the platform 11 thereof, can be adjusted at any vertical position, upon operation of motor 10 by movement, up or down, as schematically indicated by the double arrow C.

The entire apparatus is retained in a frame 13, to which the tubular elements 4 are attached.

Figure 4:
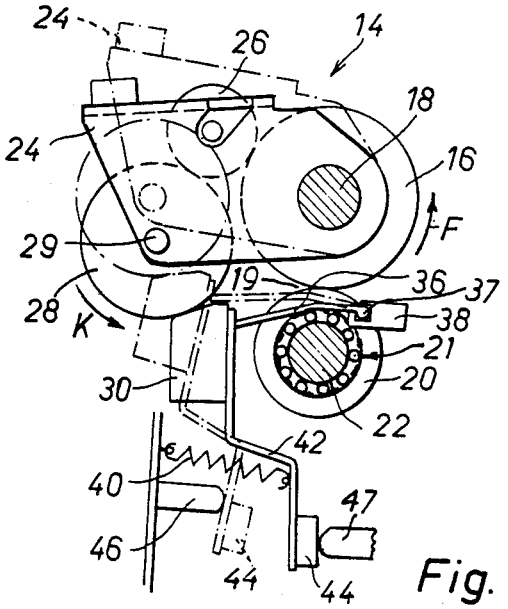
FIG. 4 is a fragmentary section along line IV—IV of FIG. 2.

The uppermost sheet of paper of the stack 12 engages a roller 28 (FIGS. 1, 4) of a sheet-separating device 14, which includes three rollers 16, 20, 28. The first or lower roller 20, together with a second roller 16, positioned immediately vertically thereabove, defines a feeding nip 19 for the separated paper sheets, being fed in the direction of the arrow D (FIG. 1). A third roller 28 is rotatably retained in a housing 24. It engages from below towards a separating element 30, formed as a friction plate or friction element. The housing 24 is pivotable about a horizontal shaft 18.

Shaft 18 is rotatable and drives the roller 16. The third roller 28 is driven from the roller 16 via an idler or transfer roller 26. A motor 56 (FIG. 2) has a drive belt 58 which drives the shaft 18 when the motor 56 is energized. Shaft 18 has disks 35 secured thereto which have an outer diameter corresponding approximately to the outer diameter of the second roller 16.

A shaft 22 is positioned parallel to the shaft 18. The first roller 20 is located on the shaft 22. A reverse movement lock is located between the first roller 20 and the shaft 22. Shaft 22 is journalled in the frame 13. The arrangement is so made that the first roller 20 can rotate freely in the direction of the arrow E (FIG. 1), but is prevented from rotating in the opposite direction. A well-known one-way clutch or free-wheeling arrangement 21 is used in connection therewith. FIG. 5 shows the detail of the one-way clutch.

Referring to FIG. 5: An inner ring 64 is secured to the shaft 22. An outer ring 66 is secured to the circumference of the roller 20, which may be formed by a friction material, for example plastic or rubber. A space between the inner and outer rings 64, 66 provides room for a plurality of clamping rollers or balls 62 which are guided in a wedge-shaped curve track 68 of the outer ring 66. Engagement pins 70, spring-loaded by weak springs 72, have the tendency to press the rollers or balls 62 in a direction against the narrower portion of the cam or curved track 68.

Operation, with reference to FIG. 5: Upon rotation of the shaft 22 in the direction of the arrow G, the clamping rollers or balls 62 will carry the outer ring 66 along with the inner ring, so that rotary movement of the shaft 22 is transferred to the roller 20. If the shaft 22 is stationary, that is carries out no movement in the direction of the arrow G, roller 20 can freely rotate in direction of the arrow E in free-wheeling rotation, since the clamping rollers or balls 62 will move into the widened portion of the cam tracks 68, thereby interrupting motion or movement transfer between the outer ring 66 and the inner ring 64.

Various other types of one-way clutches or free-wheeling arrangements may be used, for example clamping wedges, or even ratchets, if the tooth division of the ratchets is fine, so that only very little dead motion is caused thereby.

Figure 3:
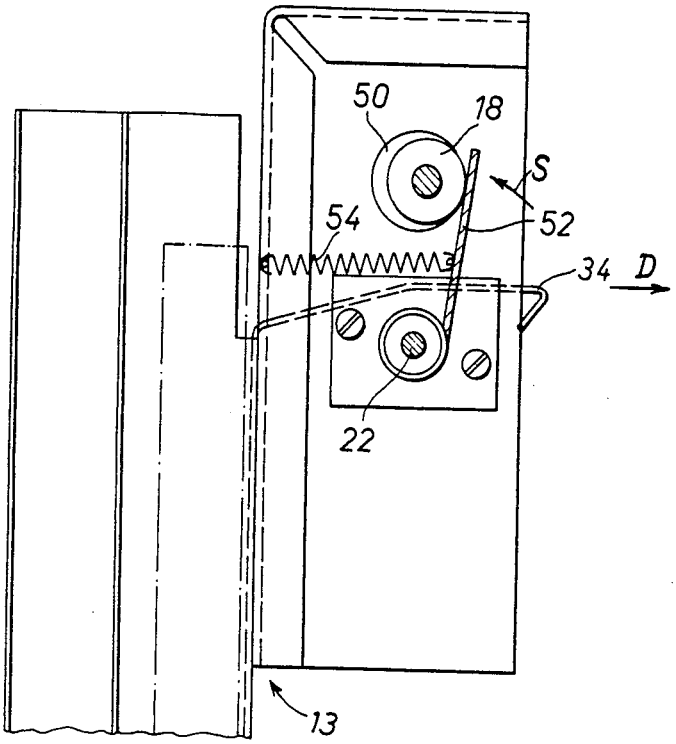
FIG. 3 is a fragmentary view of the device taken in the direction of the viewing arrow A of FIG. 2.

The single-sheet separating or selecting apparatus includes (see FIG. 3) an eccenter disk 50, secured to the shaft 18. The shaft 22, carrying the first roller 20, is rigidly connected to a pivot arm 52, which extends from the shaft 22 and is engagement with the eccenter 50. A spring 54, secured to the frame of the machine and to the arm 52, insures engagement of the arm 52 with the eccenter 50.

Operation of reverse rotation of the roller 20:

Upon rotation of shaft 18, the rocker arm 52 and with it shaft 22 is rocked back-and-forth. Since the one-way clutch 21 (FIGS. 4 and 5) prevents rotation of the first roller 20 by the clamping action of the clamping rollers or balls 62, movement of the shaft 22 in the direction of the arrow G (FIG. 5) is transferred to the first roller 20, so that the first roller 20 will be constrained to move in a direction which is counter that of the normal direction of rotation E which transports a sheet in the direction of the arrow D (FIG. 1).

In addition to the reverse-directed rotation of the first roller 20, a separating element 30 which has an inclined surface 32 is positioned such that the inclined surface 32 faces the second roller 28. The separating element 30 has a friction surface, for example an end strip made of rubber, or may be made entirely of rubber. The third roller 28 engages the upper sheet of the stack 12 at its leading edge. The axis of rotation 29 of the third roller 28 is located vertically, or at least approximately vertically, over the edge of the stack 12 of the sheets. The separating element 30 is secured (see FIG. 4) to a carrier arm 36 so as to be pivotable therewith. The carrier arm 36 can pivot about a joint 37, located in a holder 38. The joint 37 is located—in the direction of transport moement D of the sheet—behind the third roller 28 and below its axis of rotation 29.

A downwardly directed bail 42 is connected to the separating body 30. A tension spring 40 holds the bail 42 in position. The spring 40 has the tendency to press the separating element 30 against the circumference of the third roller 28. The lower end of the bail 42 cooperates with sensors which respond to approach of the end portion 44, which may include a special sensing body, to then generate an electrical switching pulse. The switching pulse controls the drive motor 10 of the elevator stack 3 to be either engaged or disengaged. The sensors 46, 47 may be capacitative or magnetic elements, responding to approach of the body 44, or may be microswitches which are directly operated by engagement with the lower end of the bail 42 to cause connection or de-energization of the motor 10, when a predetermined lower or upper position of the elevator 3 is reached. It is, of course, also possible to control the operation of the motor directly by the pivotable housing element 24.

Operation—lifting of stack: Let it be assumed that the stack 12 is to be raised, by raising the elevator 3 and causing upward movement. Upon upward movement of the stack, the uppermost sheet of the stack 12 will engage the third roller 28, lifting the third roller 28 upwardly, since the housing 24, retaining the third roller 28, can pivot upwardly about shaft 18 as a pivot axis. The upward position is shown in chain-dotted lines in FIG. 4. An angle of at least 15°, preferably approximately 30°, is provided between the contact position of the third roller 28 and the uppermost sheet and the contact position of the separating body 30. The tension spring 40 causes the separating body or element 30 to move with the pivoting movement of the roller 28, so that the bail 42 will assume the position shown in FIG. 4 in chain-dotted lines. When the roller 28, and with it the bail 42, has reached the position in which the body 44 approaches the sensor 46, sensor 46 will provide a switching signal or switching pulse to de-energize the drive of the motor 10, thus interrupting raising of the platform and hence of the stack 12. As sheets are fed from the stack 12, the third roller 28 and with it the housing 24 will slowly drop until they will reach the full-line position of FIG. 4, at which time the body 44 will approach the second sensor 47 which causes connection of the motor 10 to again raise the elevator 3 for the stack 12. Pivoting movement of the housing 24, thus, within a predetermined angular range provides for connection and disconnection of the motor 10. The housing 24, however, can pivot and tilt so that a plurality of sheets can be fed without operating the motor 10 each time. This intermittent operation of the motor 10, only from time to time, substantially contributes to overall reliability of operation.

Single sheet feeding: Upon energization of the motor 56 (FIG. 2), shaft 18 will be driven via belt 58, causing drive of the second roller 16 in the direction of the arrow F, consequently drive of the idler roller 26, by frictional engagement, and additional drive of the third roller 28 in the same direction of rotation as the second drive roller 16. Engagement of the third roller 28 with the topmost sheet causes gripping of the topmost sheet between the roller 28 and the the separating element 30. This is the first separation between sheets which, in most instances, is sufficient to feed only a single sheet in the direction of the arrow F. This sheet is then transported by gripping the sheet in the pull-in or feed nip 19 (FIG. 1) between the first and second rollers 20, 16, and guided therethrough.

The first roller 20 rotates freely in the direction of the arrow E, turning loosely, until the shaft 22, by rotation of the eccenter 50, causes a counter-directed or reverse rocking movement. This counter-directed movement is transferred by the pivot arm 52 to the first roller 20 and reliably separates a possible second sheet which may have adhered to the top sheet in the second separating stage, so that only a single sheet will be fed in the direction of the arrow D (FIG. 2).

The sheet which is supplied is guided on a guide surface 34 to a further processing apparatus, for example a copy machine, a typewriter, a word processor printer, or the like, or any other device requiring single sheet supply.

The structure thus has two serially connected or serially arranged—in the direction of transport movement—separating stations. The serial arrangement of two separating stations reliably prevents double feeding of paper sheets which, in apparatus subsequently connected to the separating apparatus, may cause malfunction or misfeeding thereof. The firsst roller 20 not only generates a frictional resistance to the sheets to be transported but, in addition, in oppositely directed movement, that is, movement opposite to the transport direction D of any sheet. Multiple and specifically double supplied sheets are thus reliably separated, even if they adhered with substantial adhesive force.

Separation of the double sheets is effected not only at the leading edge of the sheets but, additionally, when the sheets reach the nip between the rollers 16, 20, and the eccenter 50 causes counter-directed movement. A further sheet can be fed by the third roller 28 only when the preceding sheet has been transported away. The rollers 16, 20, 28, preferably, have outer covers or jackets which have a high-friction surface, for example soft rubber or the like. The inclined surface 32 of the separating body, likewise, preferably has a high-friction surface.

Various changes and modifications may be made; for example, the separating device 14 can be so modified that roller 20 is located above the sheet, and roller 16 is driven. The feeding of sheets can be reversed, for example from the top downwardly, rather than from the bottom up.

Only few elements, each readily available in the sheet-fed office supply equipment field, need be used: a guide frame 2, to guide the elevator 3; a single-sheet separating unit 14, all retained on a frame 13.

Various other changes and modifications may be made, and any features described herein may be used with any of the others, within the scope of the inventive concept.

I claim:

1. Single-sheet separating apparatus to separate an outermost single sheet from a stack (12) and feed said single sheet in predetermined feeding direction (D) having a first roller (20) and a second roller (16), said rollers being positioned to define between the circumferences thereof a feeding nip (19), said apparatus further comprising, in accordance with the invention, a first shaft (22);

a one-way clutch (21) interposed between the shaft and the first roller (20) and permitting rotation of the first roller only in the feeding direction (D) while blocking rotation in reverse direction (G) of said first roller (20);

and means (18, 50, 52) coupled to said first shaft for imparting to said first shaft a rocking movement about a limited rotary angle to rotate said first roller (20) in said reverse direction (G) for said limited rotary angle to engage a possibly present second sheet, adhering to said single sheet, and prevent feeding of said second sheet through said feeding nip; a third roller (28) located immediately above the outermost sheet of the stack and engageable therewith;

a separating element (30) located adjacent the edges of the sheets of the stack which form the forward or leading edges in said predetermined feeding direction (D) and positioned in surface engagement with said third roller;

one of said first or second rollers (20, 16) being driven;

and a rotation transfer roller (26) between said one of said first or second rollers which is driven and said third roller to transfer rotary movement thereto and provide for feeding of a sheet in said predetermined feeding direction (D) between said third roller and said separating element (30), said third roller being located in advance—in feeding direction (D)—of the feeding nip (19) defined between the circumferences of the first roller and the second roller, said third roller and separating element (30) forming a first separating stage, and said first roller and second roller in combination with the means (18, 50, 52) for imparting to said first shaft a rocking movement forming a second sheet separating stage, downstream, in said feeding direction (D) from said first separating stage.

2. Apparatus according to claim 1, wherein said means (18, 50, 52) coupled to said first shaft to impart to said first shaft a rocking movement comprises a rotating second shaft (18);

an eccenter (50) secured to said rotating second shaft (18) and lever means (52) coupled to said first shaft and engaging the eccenter to rock the first shaft (22) in said reverse direction upon engagement of an eccentric portion of the eccenter with said lever.

3. Apparatus according to claim 1, wherein said second shaft (18) comprises a feeding shaft;

and the second roller (16) is secured to rotate with said second shaft.

4. Apparatus according to claim 1, further including a second shaft (18) to which said second roller (16) is secured, said transfer roller (26) being in engagement with said second roller and said third roller.

5. Apparatus according to claim 4, wherein said first roller and third roller are located on one major surface side of said outermost single sheet, and the separating element (30) and the first roller (20) are located at the opposite major side of the sheet.

6. Apparatus according to claim 1, further comprising a pivotable roller housing (24) pivotable about the axis of rotation of the second roller (16) and retaining said third roller (28);

and wherein the axis of rotation (29) of the third roller is positioned for at least approximate alignment with a theoretical line extending beyond the edges of the sheets of the stack (12);

and a pivotable holding frame (36, 42) securing said separating element (30) in position, said pivotable holding frame being pivotable about a pivot axis which is parallel to the pivot axis of said housing (24) and positioned offset with respect thereto along the directional extent of the edges of the sheets of said stack.

7. Apparatus according to claim 6, wherein said separating element (30) has an inclined end surface tangentially engageable with the circumference of the third roller and resiliently urged thereagainst to follow pivoting movement of the third roller, with the housing, upon change in level of the outermost sheet in the stack as sheets are removed from said stack.

8. Apparatus according to claim 7, further including electrical switching means (44, 46, 47) responsive to pivoting movement of said holding frame as the holding frame follows the pivoting movement of the third roller, and hence of the pivotable housing (24) therefor;

a paper sheet stack elevator (3) including a motor, said motor being connected to and controlled by said switching means for intermittent raising movement of the stack upon deflection of the third roller, and hence of the holding frame of the separating element and control of the electrical switching means thereby.

9. Apparatus according to claim 8, wherein said holding frame includes a switching arm (42) coupled to the separating element, and respectively controlling operation of the electrical switching means.

10. Apparatus according to claim 8, wherein said elevator comprises a pair of spaced vertical guide rails (6);

a platform (11) vertically movable within said guide rails;

and a positive drive belt (8) coupling the motor (10) and the platform to move the platform, when the motor is energized, in a direction to place the outermost sheet in contact with the third roller (28), and to lift the housing until the separating element (30), and with it its holding frame, has pivoted about its pivot axis to an extent at which the switching means are operated to de-energize the motor, feeding of subsequent sheets causing dropping of the third roller, and hence of the housing and the separating element until the holding frame for the separating element has moved to a position at which the switching means are again operated for energizing the motor to again lift the stack.

11. Apparatus according to claim 8, wherein said means (18, 50, 52) coupled to said first shaft to impart to said first shaft a rocking movement comprises a rotating second shaft (18);

an eccenter (50) secured to said rotating second shaft (18) and lever means (52) coupled to said first shaft and engaging the eccenter to rock the first shaft (22) in said reverse direction upon engagement of an eccentric portion of the eccenter with said lever.

12. Apparatus according to claim 11, whereiin said second shaft (18) comprises a feeding shaft;

and the second roller (16) is secured to rotate with said second shaft.

13. Apparatus according to claim 11, further including a second shaft (18) to which said second roller (16) is secured, said transfer roller (26) being in engagement with said second roller and said third roller.

14. Apparatus according to claim 13, wherein said first roller and third roller are located on one major surface side of said outermost single sheet, and the separating element (30) and the first roller (20) are located at the opposite major side of the sheet.

15. Single-sheet separating apparatus to separate an outermost single sheet from a stack (12) and feed said single sheet in predetermined feeding direction (D) having a first roller (20) and a second roller (16), said rollers being positioned to define between the circumferences thereof a feeding nip (19), said apparatus further comprising, in accordance with the invention, a first shaft (22);

a one-way clutch (21) interposed between the shaft and the first roller (20) and permitting rotation of the first roller only in the feeding direction (D) while blocking rotation in reverse direction (G) of said first roller (20);

means (18, 50, 52) coupled to said first shaft for imparting to said first shaft a rocking movement about a limited rotary angle to rotate said first roller (20) in said reverse direction (G) for said limited rotary angle to engage a possibly present second sheet, adhering to said single sheet, and prevent feeding of said second sheet through said feeding nip wherein said means (18, 50, 52) coupled to said first shaft to impart to said first shaft a rocking movement comprises a rotating second shaft (18) forming a feeding shaft, the second roller (16) being secured to rotate with said second shaft;

an eccenter (50) secured to said rotating second shaft (18) and lever means (52) coupled to said first shaft and engaging the eccenter to rock the first shaft (22) in said reverse direction upon engagement of an eccentric portion of the eccenter with said lever;

means for supporting said stack for movement between an elevated and a lowered position;

a third roller (28) engaging the outermost sheet of the stack and being movable together with said stack, in rising and dropping direction, said third roller being located in advance—in feeding direction (D)—of the feeding nip (19), said third roller (28) removing a sheet from the stack and forming a first separating stage, and said first roller and second roller in combination with the means (18, 50, 52) for imparting to said first shaft a rocking movement forming a second sheet separating stage, downstream—in said feeding direction (D)—from said first separating stage;

electrical switching means (44, 46, 47) responsive to rising and dropping movement of the third roller and hence of the stack; and a paper sheet stack elevator (3) including a motor, said motor being connected to and controlled by said switching means for intermittent raising movement of the stack upon deflection of the third roller, and hence of the holding frame of the separating element and control of the electrical switching means thereby.

16. Single-sheet separating apparatus to separate an outermost single sheet from a stack (12) and feed said single sheet in predetermined feeding direction (D) having a first roller (20) and a second roller (16), said rollers being positioned to define between the circumferences thereof a feeding nip (19), said apparatus further comprising, in accordance with the invention, a first shaft (22);

a one-way clutch (21) interposed between the shaft and the first roller (20) and permitting rotation of the first roller only in the feeding direction (D) while blocking rotation in reverse direction (G) of said first roller (20);

means (18, 50, 52) coupled to said first shaft for imparting to said first shaft a rocking movement about a limited rotary angle to rotate said first roller (20) in said reverse direction (G) for said limited rotary angle to engage a possibly present second sheet, adhering to said single sheet, and prevent feeding of said second sheet through said feeding nip;

a third roller (28) located immediately above the outermost sheet of the stack and engageable therewith;

a separating element (30) located adjacent the edges of the sheets of the stack which form the forward or leading edges in said predetermined feeding direction (D) and positioned in surface engagement with said third roller;

one of said first or second rollers (20, 16) being driven;

and a rotation transfer roller (26) between said one of said first or second rollers which is driven and said third roller to transfer rotary movement thereto and provide for feeding of a sheet in said predetermined feeding direction (D) between said third roller and said separating element (30), said third roller being located in advance—in feeding direction (D)—of the feeding nip (19) defined between the circumferences of the first roller and the second roller, said third roller and separating element (30) forming a first separating stage, and said first roller and second roller in combination witth the means (18, 50, 52) for imparting to said first shaft a rocking movement forming a second sheet separating stage, downstream, in said feeding direction (D) from said first separating stage;

wherein said separating element (30) has an inclined end surface tangentially engageable with the circumference of the third roller and resiliently urged thereafter to follow movement of the third roller, upon change in level of the outermost sheet in the stack as sheets are removed from said stack, electrical switching means (44, 46, 47) including a switching arm (42) coupled to the separating element (30), and respectively controlling operation of the electrical switching means; and a paper sheet stack elevator (3) including a motor, said motor being connected to and controlled by said switching means for intermittent raising movement of the stack

* * * * *